US011331681B2

(12) United States Patent
Seitz et al.

(10) Patent No.: US 11,331,681 B2
(45) Date of Patent: May 17, 2022

(54) FLUID TIP FOR SPRAY APPLICATOR

(71) Applicant: Carlisle Fluid Technologies, Inc., Scottsdale, AZ (US)

(72) Inventors: David Martin Seitz, Riga, MI (US); Daniel Joseph Hasselschwert, Sylvania, OH (US)

(73) Assignee: Carlisle Fluid Technologies, Inc., Scottsdale, AZ (US)

( * ) Notice: Subject to any disclaimer, the term of this patent is extended or adjusted under 35 U.S.C. 154(b) by 139 days.

(21) Appl. No.: 16/529,585

(22) Filed: Aug. 1, 2019

(65) Prior Publication Data

US 2020/0047197 A1 Feb. 13, 2020

Related U.S. Application Data

(60) Provisional application No. 62/715,656, filed on Aug. 7, 2018.

(51) Int. Cl.
*B05B 3/10* (2006.01)
*B05B 3/08* (2006.01)
(Continued)

(52) U.S. Cl.
CPC ..... *B05B 3/1014* (2013.01); *B05B 3/082* (2013.01); *B05B 3/1064* (2013.01); *B05B 5/0407* (2013.01); *B05B 15/55* (2018.02)

(58) Field of Classification Search
CPC ..... B05B 3/082; B05B 3/1014; B05B 3/1064; B05B 3/1007; B05B 3/1021; B05B 3/1028; B05B 5/0407; B05B 15/55
See application file for complete search history.

(56) References Cited

U.S. PATENT DOCUMENTS 4,369,924 A 1/1983 Morishita et al.
4,458,844 A 7/1984 Mitsui
(Continued)

FOREIGN PATENT DOCUMENTS

EP 0785032 A1 7/1997
GB 887450 A 1/1962
(Continued)

OTHER PUBLICATIONS

PCT International Search Report & Written Opinion for PCT Application No. PCT/US2019/045553 dated Oct. 31, 2019, 15 pgs.
(Continued)

*Primary Examiner* — Darren W Gorman
(74) *Attorney, Agent, or Firm* — Fletcher Yoder, P.C.

(57) ABSTRACT

A spray system includes a spray applicator configured to apply a fluid to a target. The spray system also includes a rotary bell cup of the spray applicator, a splash plate of the spray applicator coupled to the rotary bell cup, and a fluid tip of the spray applicator. The fluid tip is configured to output the fluid onto the rotary bell cup. The fluid tip includes a fluid tip passage extending along a longitudinal fluid tip axis of the fluid tip. The longitudinal fluid tip axis intersects with the splash plate of the spray applicator. The fluid tip also includes a fluid exit port configured to output the fluid from the fluid tip passage onto the rotary bell cup. The fluid exit port extends along a fluid exit axis disposed at an angle relative to the longitudinal fluid tip axis of the fluid tip.

14 Claims, 8 Drawing Sheets

(51) Int. Cl.
*B05B 15/55* (2018.01)
*B05B 5/04* (2006.01)

(56) References Cited

U.S. PATENT DOCUMENTS

| | | | | |
|---|---|---|---|---|
| 4,785,995 | A | 11/1988 | Yamane et al. | |
| 4,896,834 | A | 1/1990 | Coeling et al. | |
| 4,919,333 | A | 4/1990 | Weinstein | |
| 4,943,005 | A | 7/1990 | Weinstein | |
| 5,909,849 | A | 6/1999 | Yamasaki et al. | |
| 5,934,574 | A | 8/1999 | van der Steur | |
| 6,029,905 | A | 2/2000 | van der Steur | |
| 6,341,734 | B1 * | 1/2002 | Van Der Steur | B05B 3/1014 239/223 |
| 6,557,781 | B2 | 5/2003 | Kon | |
| 6,811,094 | B2 | 11/2004 | Kon et al. | |
| 7,726,586 | B2 | 6/2010 | Murai et al. | |
| 7,861,945 | B2 | 1/2011 | Yasuda et al. | |
| 8,690,076 | B2 | 4/2014 | Yamasaki et al. | |
| 8,720,797 | B2 | 5/2014 | Yamasaki et al. | |
| 2009/0255463 | A1 | 10/2009 | Seitz et al. | |
| 2019/0030548 | A1 * | 1/2019 | Park | B05B 3/1064 |

FOREIGN PATENT DOCUMENTS

| | | | | |
|---|---|---|---|---|
| GB | 1107060 | A | 3/1968 | |
| JP | S6086468 | U | 6/1985 | |
| JP | 02152568 | A * | 6/1990 | B05B 3/1064 |
| JP | H02112353 | U | 9/1990 | |
| JP | 2008290007 | A | 12/2008 | |
| WO | WO-2017126792 | A1 * | 7/2017 | B05B 3/1021 |

OTHER PUBLICATIONS

Japanese Office Action for JP Application No. 2021-506529, dated Mar. 29, 2021, 4 pgs.

* cited by examiner

FLUID TIP FOR SPRAY APPLICATOR

CROSS-REFERENCE TO RELATED APPLICATION

This application claims priority from and the benefit of U.S. Provisional Patent Application No. 62/715,656, entitled "FLUID TIP FOR SPRAY APPLICATOR," filed Aug. 7, 2018, which is hereby incorporated by reference in its entirety for all purposes.

BACKGROUND

The subject matter disclosed herein relates generally to a spray applicator, and more particularly, to a fluid tip for a spray applicator.

Spray applicators, such as spray guns, may be used to apply a spray coating to a wide variety of target objects. A fluid may flow through the spray applicator and exit a fluid tip of the spray applicator. To achieve a more even distribution of fluid exiting the spray applicator, a splash plate and a rotary bell cup are typically used. Fluid exiting the fluid tip contacts the splash plate and is dispersed over a surface area of the rotary bell cup. The fluid then exits the spray applicator toward the target object. Unfortunately, as fluid contacts and is distributed by the splash plate, the splash plate may experience wear and degradation, which may lead to increased costs associated with spray gun applicator maintenance.

BRIEF DESCRIPTION

Certain embodiments commensurate in scope with the originally claimed subject matter are summarized below. These embodiments are not intended to limit the scope of the claimed subject matter, but rather these embodiments are intended only to provide a brief summary of possible forms of the disclosed subject matter. Indeed, the disclosed embodiments may encompass a variety of forms that may be similar to or different from the embodiments set forth below.

In one embodiment, a spray system includes a spray applicator configured to apply a fluid to a target. The spray system also includes a rotary bell cup of the spray applicator, a splash plate of the spray applicator coupled to the rotary bell cup, and a fluid tip of the spray applicator. The fluid tip is configured to output the fluid onto the rotary bell cup. The fluid tip includes a fluid tip passage extending along a longitudinal fluid tip axis of the fluid tip. The longitudinal fluid tip axis intersects with the splash plate of the spray applicator. The fluid tip also includes a fluid exit port configured to output the fluid from the fluid tip passage onto the rotary bell cup. The fluid exit port extends along a fluid exit axis disposed at an angle relative to the longitudinal fluid tip axis of the fluid tip.

In another embodiment, a spray system includes a fluid tip of a spray applicator. The fluid tip is configured to output a fluid onto a rotary bell cup of the spray applicator. The fluid tip includes a fluid tip passage extending along a longitudinal fluid tip axis of the fluid tip and a fluid exit port configured to output the fluid onto the rotary bell cup. The fluid exit port includes a fluid exit axis disposed at an angle relative to the longitudinal fluid tip axis of the fluid tip.

In a further embodiment, a method of operating a spray system includes flowing a fluid along a fluid tip passage of a fluid tip of a spray applicator, where the fluid tip passage extends along a longitudinal fluid tip axis of the fluid tip. The method further includes directing the fluid through a fluid exit port along a fluid exit axis, where the fluid exit port is fluidly coupled to the fluid tip passage, and where the fluid exit axis is disposed at an angle relative to the longitudinal fluid tip axis. The method also includes depositing the fluid from the fluid exit port onto a bell cup surface of a rotary bell cup.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
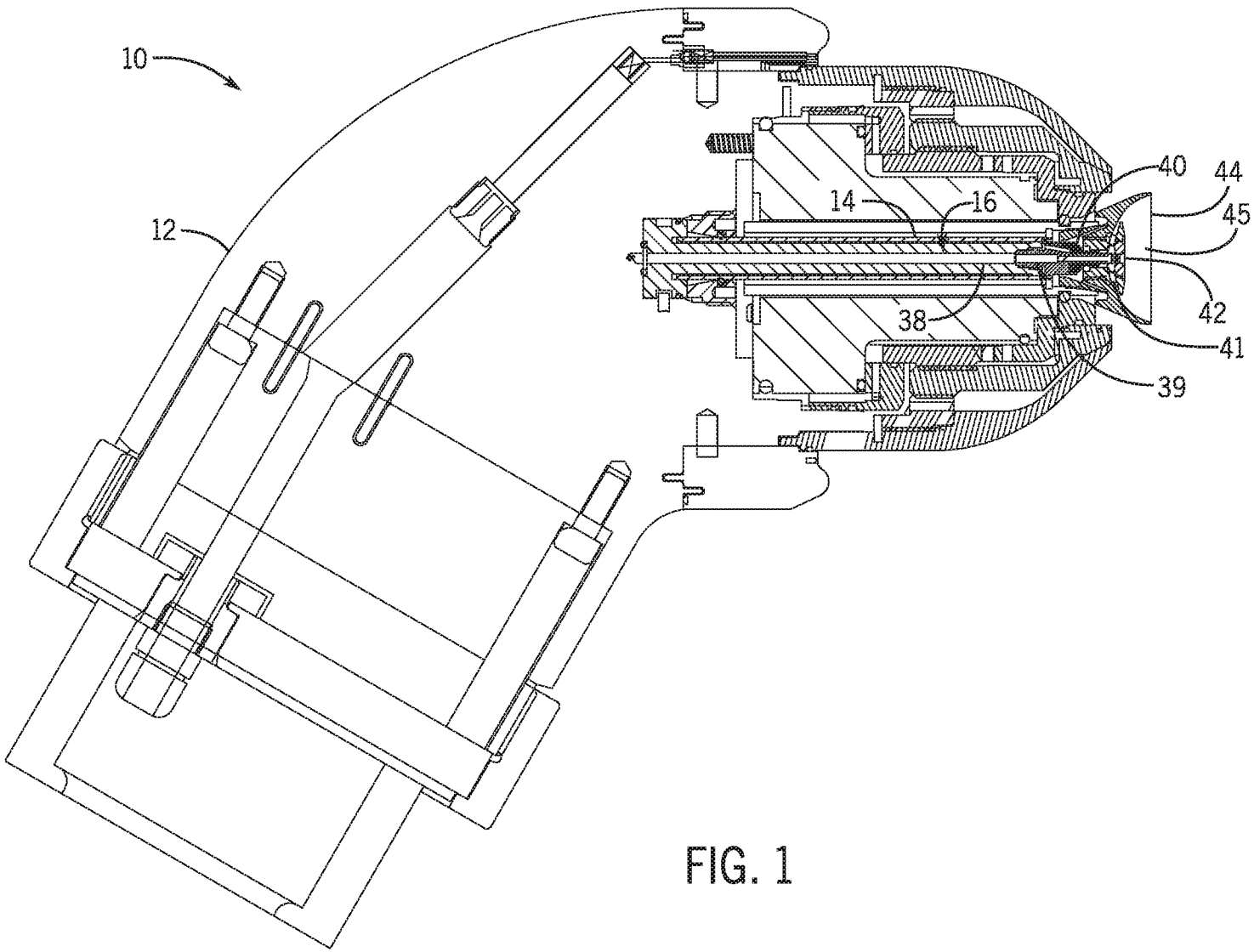
FIG. 1 is a side view of an embodiment of a spray system, illustrating a spray applicator having a fluid tip, in accordance with aspects of the present disclosure.

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements.

Embodiments of the present disclosure are directed to a fluid tip of a spray applicator configured to direct a fluid or an air-fluid mixture from the fluid tip toward a rotary bell cup of the spray applicator. The spray applicator may be a handheld manual spray gun, an automated spray unit (e.g., a robotic mounted spray unit), a spray booth mounted spray unit, or any other suitable spray device. The spray applicator also may include a pneumatic driven spray device, which uses a gas (e.g., air) to help atomize a liquid, shape a spray of the liquid, operate a valve of the sprayer, or a combination thereof. The spray applicator may include the rotary bell cup, which rotates to help create a spray. For example, the rotary bell cup may rotate at speeds ranging from 10,000 rotations per minute (rpm) to 100,000 rpm. In some embodiments, the fluid tip may remain stationary relative to a body of the spray applicator as the rotary bell cup rotates. The spray applicator may include an electrostatic spray device, which generates an electric field to help attract a spray onto a target object. Furthermore, the spray applicator may be a spray coating device configured to produce a spray of a coating material, such as paint, for creating a coating on a surface of an object. The fluid source may include a fluid conduit, a fluid container (e.g., a gravity feed fluid container, a siphon feed fluid container, a multi-fluid feed container, a pressurized fluid container, etc.), or any combination thereof. The fluid tip may be used to direct a fluid or an air-fluid mixture exiting the fluid conduit toward the rotary bell cup and away from (i.e., not directly toward) a splash plate of the spray applicator. In particular, the fluid tip may include one or more ports disposed at an angle relative to the splash plate, such that the fluid or the air-fluid mixture exits the fluid tip at the angle away from the splash plate and toward the rotary bell cup.

Turning to the drawings, FIG. 1 is a side view of an embodiment of a spray system 10 including a spray applicator 12 for spraying a coating material (paint, ink, varnish, etc.). The spray applicator 12 may be any spray coating device (e.g., gravity-feed, siphon, high-volume low-pressure, or pressure) suitable for spraying coating materials. The spray applicator 12 may include various components configured to provide fluid passages to enable application of the spray material. In the illustrated embodiment, the spray applicator 12 includes a fluid tube 14 and a fluid tip 40 configured to provide fluid passages for the coating material to travel through the spray applicator 12 and toward a target to be coated with the coating material. The fluid tip 40 may be removably and fluidly coupled to the fluid tube 14 and/or other components of the spray applicator 12. For example, the fluid tip 40 and the fluid tube 14 may be threaded such that the fluid tip 40 may screw into or onto the fluid tube 14.

The fluid tube 14 may include a fluid passage 16. The fluid tube 14 and the fluid tip 40 may also include other types of passages. In operation, a trigger or other suitable control may be used to actuate a flow of air and fluid (e.g., coating material) through the fluid passage 16 of the fluid tube 14. In certain embodiments, the spray applicator 12 may be controlled via others means (e.g., a robotic controller, remotely, etc.). In certain embodiments, a fluid may mix with air or another fluid prior to entering the fluid passage 16. The air and fluid may mix to create an air-fluid mixture in the fluid passage 16. The fluid passage 16 may extend from the fluid tube 14 into and/or through the fluid tip 40. For example, in certain embodiments, the fluid passage 16 may include a fluid tube passage 38 of the fluid tube 14 and a fluid tip passage 39 of the fluid tip 40 such that the fluid tube passage 38 and the fluid tip passage 39 form the fluid passage 16 when the fluid tip 40 is coupled to the spray applicator 12. In some embodiments, the spray applicator 12 may include additional fluid passages configured to flow a fluid through the spray applicator 12.

In certain embodiments, the fluid passage 16 may be configured to flow a fluid and/or an air-fluid mixture. As such, the spray applicator 12 may be configured to flow and apply a fluid and/or an air-fluid mixture. For example, the spray system 10 may include an air inlet and a fluid inlet to receive air and fluids into an air passage and a fluid passage, respectively, of the spray system 10. The air inlet (e.g., port) and the fluid inlet (e.g., port) may be coupled to one or more spray components of the spray system 10, such as an air source and a fluid source. For example, the air inlet may couple to an air compressor or an air reservoir (e.g., air tank). The air inlet may couple to the air source using a variety of connections. For instance, the air inlet may include a first connector (e.g., male connector), and the air source may include a corresponding second connector (e.g., female connector). In some embodiments, the air inlet may be a female connector, and the air source may be a male connector. Similarly, the fluid inlet may couple to the fluid source (e.g., paint mixer, pressure pot, gear pump, etc.), such as a fluid reservoir (e.g., disposable cup, fluid pressure container) or another fluid source using a variety of connections. For instance, the fluid inlet may include a male or female connector that couples to a corresponding male or female connector of the fluid source.

The spray applicator 12 is configured to flow a fluid or an air-fluid mixture through the fluid passage 16 which may extend into the fluid tip 40. As described above, the fluid tube passage 38 and the fluid tip passage 39 may form the fluid passage 16. The fluid tip 40 may be disposed at an end of the spray applicator 12 and may be configured to deliver the fluid or the air-fluid mixture to a rotary bell cup 44 of the spray applicator 12. The spray applicator 12 may also include a splash plate 42 coupled to the rotary bell cup 44. In traditional embodiments, a splash plate may be configured to distribute a fluid or an air-fluid mixture exiting a fluid tip onto a rotary bell cup. In other words, traditional spray applicators may include a splash plate configured to divert a fluid or an air-fluid mixture flow exiting the fluid tip and direct the fluid flow toward the rotary bell cup. However, in present embodiments and as will be described in greater detail below, the fluid or the air-fluid mixture is configured to flow through the fluid passage 16 and exit the fluid tip 40 at an angle toward the rotary bell cup 44 and away from the splash plate 42.

While the spray applicator 12 is configured to distribute the fluid or the air-fluid mixture directly onto the rotary bell cup 44 from the fluid tip 40, the splash plate 42 may still be included in the spray applicator 12. The splash plate 42 may be configured to block air from an environment in which the spray applicator 12 may be used from disrupting a fluid flow from the fluid tip 40 onto the rotary bell cup 44. For example, as the rotary bell cup 44 rotates and as the fluid or the air-fluid mixture exits the rotary bell cup 44, a negative pressure may be created in a bell cup region 45 of the rotary bell cup 44. Air from the environment may enter the bell cup region 45 due to the negative pressure. Without the splash plate 42, the air flowing into the bell cup region 45 may enter a fluid tip region 41 and may disrupt a flow of the fluid or the air-fluid mixture from the fluid tip 40 to the rotary bell cup 44. As such, the splash plate 42 may be configured to assist in the flow of the fluid or the air-fluid mixture onto the rotary bell cup 44 by blocking air from the environment.

Various components of the spray applicator 12 may be replaceable during operation for various reasons, such as for maintenance. For example, the fluid tube 14, the fluid tip 40, the splash plate 42, and the rotary bell cup 44, among other components, may be replaced with new or different components. Additionally, various components of the spray applicator 12 may be formed of various materials or combinations of materials. In the illustrated embodiment, the fluid tube 14 and the fluid tip 40 may be a stainless steel and/or other materials. The splash plate 42 may be a composite plastic, a hardened stainless steel, titanium, and/or other materials and may be coated with a coating (e.g., a diamond-like coating (DLC)) or plated. Further, the rotary bell cup 44 may be a composite plastic, stainless steel, and/or other materials. However, it will be appreciated that other suitable materials may be used to form the fluid tube 14, the fluid tip 40, the splash plate 42, and the rotary bell cup 44.

Figure 2:
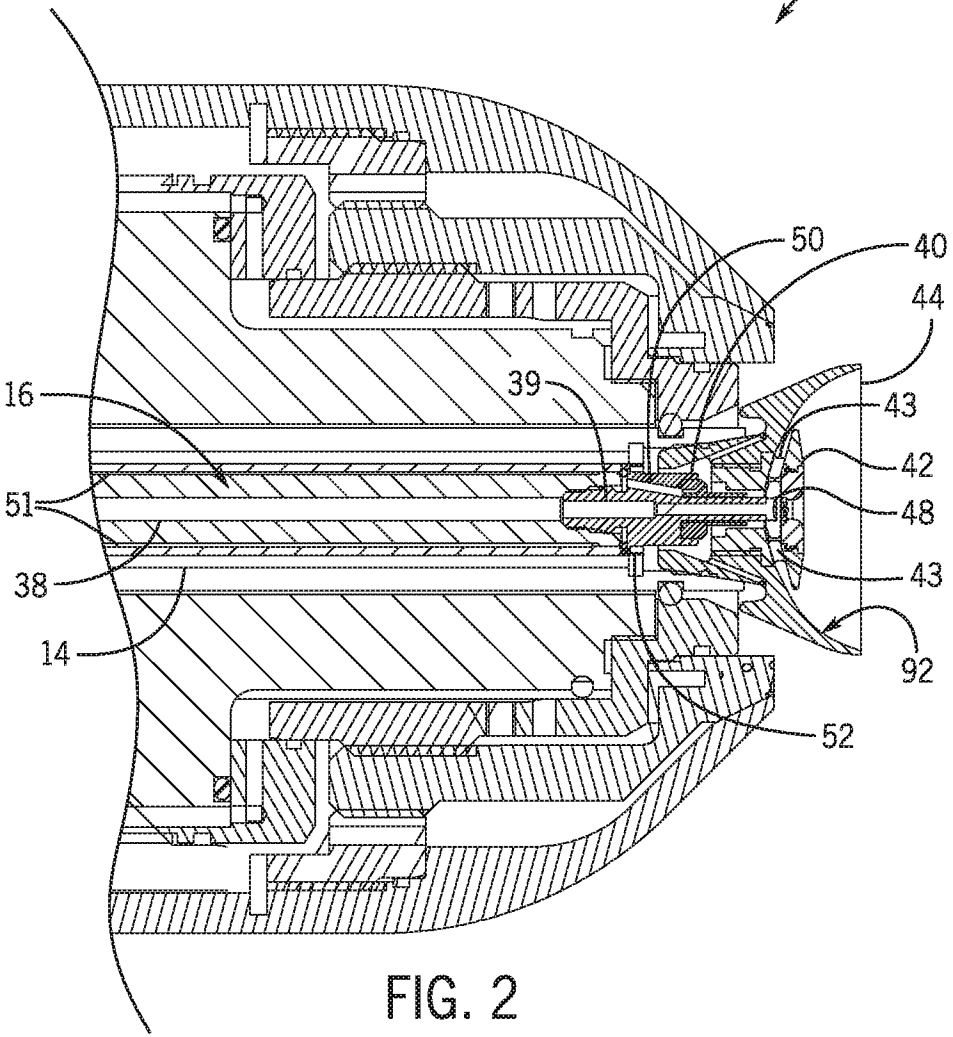
FIG. 2 is a partial cross-sectional side view of an embodiment of a fluid path through a fluid tip of the spray system of FIG. 1, in accordance with aspects of the present disclosure.

FIG. 2 is a partial cross-sectional side view of the spray applicator 12 of the spray system 10 of FIG. 1, illustrating an embodiment of the fluid tip 40 of the spray applicator 12. As described above, the spray applicator 12 may include the fluid tube 14, the fluid tip 40, the splash plate 42, and/or the rotary bell cup 44. The splash plate 42 may be coupled to the rotary bell cup 44 via connections 43. The connections 43 may be fasteners (e.g., screws, bolts, rivets, etc.). Further, while two connections (i.e., connections 43) are illustrated in FIG. 2, some embodiments of the spray applicator 12 may include a single connection, three connections, or more than three connections between the splash plate 42 and the rotary bell cup 44. In certain embodiments, the splash plate 42 may be an integral component of the rotary bell cup 44, or vice versa.

The fluid tube 14 and the fluid tip 40 may include the fluid tube passage 38 and the fluid tip passage 39, respectively, which form the fluid passage 16 in the illustrated embodiment. As described herein, a fluid or an air-fluid mixture may flow through the fluid passage 16. The fluid passage 16 and the fluid tip passage 39 may terminate adjacent to the splash plate 42 at an end portion 48 of the fluid tip 40. The fluid tip 40 may also be coupled to the fluid tube 14 via a threaded connection 52 or other suitable connection. The threaded connection 52 may include threads in both the fluid tube 14 and the fluid tip 40 that engage with one another, such that the fluid tip 40 is configured to screw into or onto the fluid tube 14. In some embodiments, the fluid tube 14 and the fluid tip 40 may be coupled by other mechanisms or features in addition to or instead of the threaded connection 52. Further, the spray applicator 12 may include a sealing mechanism disposed adjacent to the threaded connection 52 to ensure that the fluid passage 16 extending through the fluid tube 14 and the fluid tip 40 is sealed. For example, the spray applicator 12 may include one or more O-rings disposed adjacent to the threaded connection 52 to ensure that the fluid passage 16 is sealed.

The bell cup 44 may include a bell cup surface 92. The bell cup surface 92 may enable a fluid exiting the fluid tip 40 to flow along and exit the bell cup 44. As illustrated, the bell cup surface 92 is a generally curved edge of the bell cup 44. In certain embodiments, the bell cup surface 92 may include straight portion(s) in addition to curved portion(s). Additionally, certain portions or sections of the bell cup surface 92 may be disposed at angles relative to one another.

In certain embodiments, the fluid tip 40 may also include one or more fluid tip solvent passages 50. As shown, the fluid tip solvent passage 50 extends through the fluid tip 40 adjacent to, but separate from, the fluid tip passage 39. The fluid tip solvent passage 50 may be fluidly coupled to an annular fluid tube solvent passage 51 extending through the spray applicator 12. The annular fluid tube solvent passage 51 may be configured to flow a solvent down a portion of a length of the fluid tube 14 to deliver the solvent to the fluid tip solvent passage 50. As will be described in greater detail below, the fluid tip 40 may include secondary solvent passages configured to deliver solvent to components of the spray applicator 12.

The fluid tip solvent passage 50 is configured to deliver the solvent to the end portion 48 of the fluid tip 40, to the splash plate 42, and/or to the rotary bell cup 44. In some embodiments, fluid exiting the fluid tip 40 may adhere to the fluid tip 40, the splash plate 42, and the rotary bell cup 44. The solvent delivered to the fluid tip 40, to the splash plate 42, and/or to the rotary bell cup 44 may be configured to dislodge/remove fluid residue or coating material buildup and clean these components of the spray applicator 12.

Figure 3:
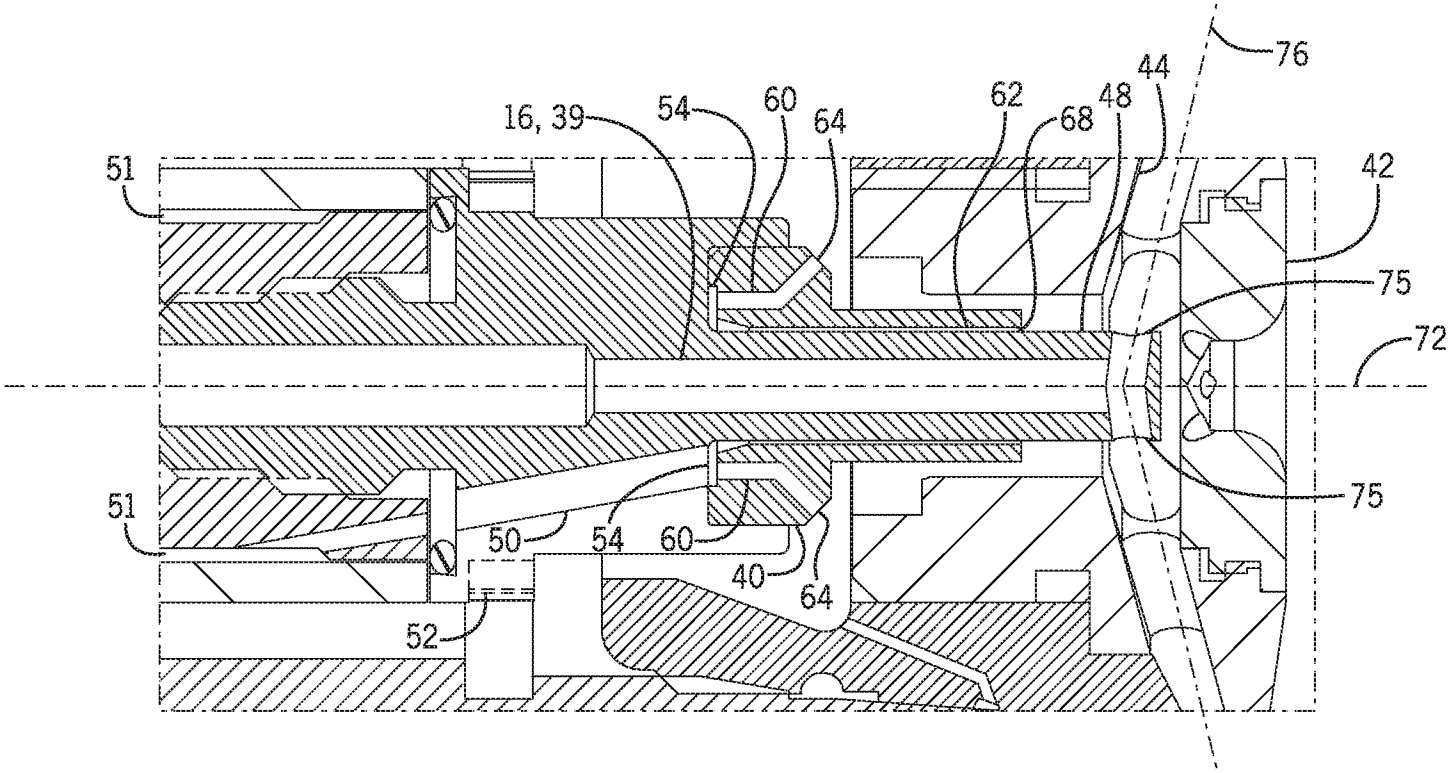
FIG. 3 is a partial cross-sectional side view of an embodiment of a fluid path through a fluid tip of the spray system of FIG. 1, in accordance with aspects of the present disclosure.

FIG. 3 is a partial cross-sectional side view of the spray applicator 12 of the spray system 10 of FIG. 1, illustrating an embodiment of the fluid tip 40 of the spray applicator 12. As described above, the fluid tip 40 may include the fluid tip passage 39 and the fluid tip solvent passage 50. Fluid or an air-fluid mixture may flow through the fluid tip passage 39 (i.e., through the fluid passage 16) along a longitudinal fluid tip axis 72 and exit the fluid tip 40 at fluid exit ports 75 along a fluid exit axis 76. The fluid tip passage 39 may be fluidly coupled to the fluid exit ports 75. As illustrated, the longitudinal fluid tip axis 72 also intersects with the splash plate 42. In this manner, a fluid or an air-fluid mixture exiting the fluid exit ports 75 of the fluid tip 40 is directed toward the rotary bell cup 44 instead of the splash plate 42. As a result, less fluid (e.g., coating material) applied by the spray applicator 12 is directed toward the splash plate 42, which may reduce wear and degradation of the splash plate 42. In some embodiments, a fluid exit port of the fluid tip 40 may disposed at an angle partially toward the splash plate 42 (i.e., at an angle relative to the longitudinal fluid tip axis 72), while still reducing direct application of the fluid or the air-fluid mixture from the fluid tip 40 to the splash plate 42, as will be described in reference to FIGS. 5-7 below.

The fluid exit ports 75 may range in size. For example, the fluid exit ports 75 may range in diameter from 0.7 millimeters (mm) to 1.62 mm, in some embodiments. Further, the fluid exit port 75 diameter selected for a particular application may depend on a viscosity of the fluid or the air-fluid mixture exiting the fluid exit ports 75. For example, in an embodiment where the spray applicator 12 is used with a fluid or an air-fluid mixture having a lower viscosity (i.e., a thinner fluid), the fluid exit ports 75 may have a smaller diameter. By contrast, in an embodiment where the spray applicator 12 is used with a fluid or an air-fluid mixture having a higher viscosity (i.e., a thicker fluid), the fluid exit ports 75 may have a larger diameter. Additionally, fluid exit ports 75 of other embodiments described herein may have similar diameters and properties. In some embodiments, the diameter of the fluid exit ports 75 is constant, whereas other embodiments of the fluid tip 40 may include fluid exit ports 75 of varying diametric dimension.

The fluid tip solvent passage 50 may be coupled to secondary solvent passages configured to distribute solvent out of the fluid tip 40 via various ports. In the illustrated embodiment, the fluid tip solvent passage 50 is coupled to secondary radial solvent passages 60 and a secondary annular solvent passage 62 via a primary annular solvent passage 54. The primary annular solvent passage 54 may surround the fluid tip passage 39. In some embodiments, the primary annular solvent passage 54 may surround only a portion of the fluid tip passage 39 or may be omitted from the fluid tip 40 such that the fluid tip solvent passage 50 is directly coupled to the secondary radial solvent passages 60 and the second annular solvent passage 62. In the illustrated embodiment, the secondary radial solvent passages 60 include two passages extending from the fluid tip solvent passage 50. In some embodiments, the fluid tip solvent passage 50 may be coupled to one of the secondary radial solvent passages 60 or the secondary annular solvent passage 62. Solvent may flow from the fluid tip solvent passage 50 to each of the secondary radial solvent passages 60 and the secondary annular solvent passage 62. The solvent may then exit the secondary radial solvent passages 60 at secondary radial solvent exit ports 64 and may exit the secondary annular solvent passage 62 at the secondary annular solvent exit port 68. Solvent exiting the secondary radial solvent exit ports 64 and the secondary annular solvent exit port 68 may be distributed over various portions of the spray applicator 12 to clean and remove fluid residue, such as residue formed by coating material applied by the spray applicator 12 during operation. For example, in the illustrated embodiment, solvent exiting the secondary radial solvent exit ports 64 may be distributed onto a rear surface (not illustrated) of the rotary bell cup 44. Solvent exiting the secondary annular solvent exit port 68 may be dispersed over and clean the end portion 48 of the fluid tip 40. Solvent exiting the secondary radial solvent exit ports 64 and the secondary annular solvent exit port 68 may also be configured to contact and clean other components/portions of the spray applicator 12 (e.g., other portions of the fluid tip 40, the splash plate 42, the rotary bell cup 44, the fluid tube 14, etc.). For example, solvent exiting the secondary annular solvent exit port 68 may contact and clean various surfaces of the splash plate 42 (e.g., a rear surface of the splash plate 42 proximate to the fluid tip 40 and a front surface of the splash plate 42 opposite of the rear surface).

Figure 4:
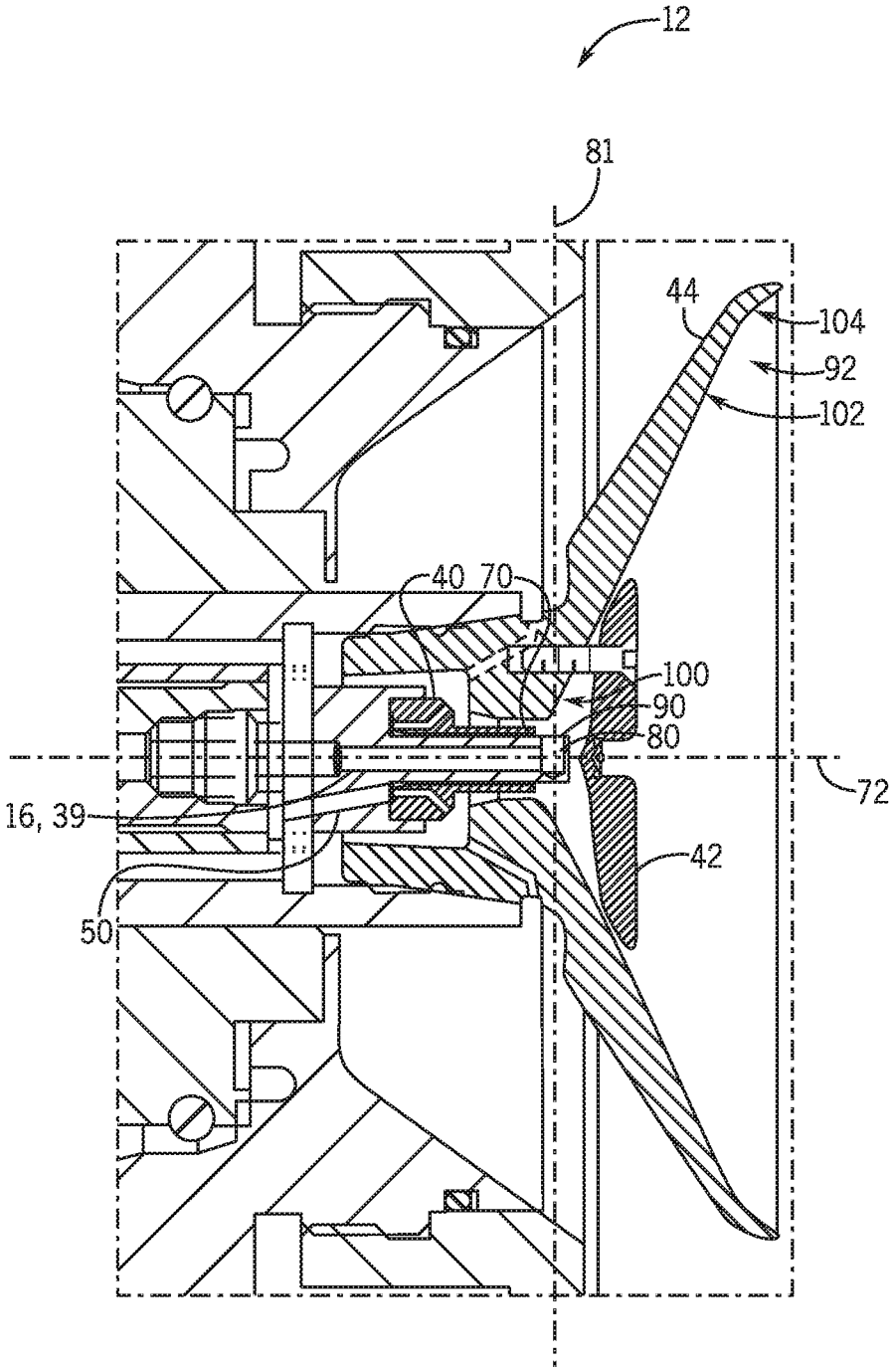
FIG. 4 is a partial cross-sectional side view of an embodiment of the fluid tip of the spray system of FIG. 1, in accordance with aspects of the present disclosure.

FIG. 4 is a partial cross-sectional side view of the spray applicator 12 of the spray system 10 of FIG. 1, illustrating an embodiment of the fluid tip 40 of the spray applicator 12. As discussed above, the spray system 10 is configured to flow a fluid or an air-fluid mixture through the fluid tip 40 along the longitudinal fluid tip axis 72, out of a fluid exit port outlet 90 of the fluid exit port 80, and onto the rotary bell cup 44. The fluid or the air-fluid mixture exits the fluid exit port outlet 90 along the fluid exit axis 81. In the illustrated embodiment, the fluid exit axis 81 is generally perpendicular to the longitudinal fluid tip axis 72 and a flow of the fluid or the air-fluid mixture through the fluid tip passage 39 (i.e., through the fluid passage 16). Additionally, the fluid exit port outlet 90 is generally flush with a side surface 70 of the fluid tip 40. As the fluid or the air-fluid mixture exits the fluid exit port outlet 90, the fluid or the air-fluid mixture is generally directed away from the splash plate 42 and toward the rotary bell cup 44.

The rotary bell cup 44 may include the bell cup surface 92 adjacent to the splash plate 42. The bell cup surface 92 may include an inner bell cup region 100, a middle bell cup region 102, and an outer bell cup region 104. The inner bell cup region 100 may be a first end portion of the bell cup surface 92 behind the splash plate 42. The outer bell cup region 104 may be a second end portion of the bell cup surface 92 generally opposite the inner bell cup region 100. The middle bell cup region 102 may be a portion of the bell cup surface 92 between the inner bell cup region 100 and the outer bell cup region 104. As illustrated, the inner bell cup region 100 is generally straight and disposed at an angle relative to the middle bell cup region 102, the middle bell cup region 102 is generally straight and disposed at an angle relative to the inner bell cup region 100 and the outer bell cup region 104, and the outer bell cup region 104 is generally straight. In certain embodiments, the inner bell cup region 100, the middle bell cup region 102, and the outer bell cup region 104 may be generally curved, parabolic, and/or may form a single continuous curve.

After exiting the fluid exit port outlet 90, the fluid or the air-fluid mixture may contact the bell cup surface 92 at the inner bell cup region 100 of the rotary bell cup 44. For example, the fluid exit axis 81 may intersect with the inner bell cup region 100 such that the fluid or the air-fluid mixture exits the fluid exit port outlet 90 along the fluid exit axis 81 and contacts the rotary bell cup 44 at the inner bell cup region 100. Additionally, the inner bell cup region 100, along with the intersection of the inner bell cup region 100 and the fluid exit axis 81, may be disposed at a portion of the bell cup surface 92 at least partially defined by a diameter of the splash plate 42. In this manner, the fluid or the air-fluid mixture may be deposited on the bell cup surface 92 at the portion at least partially defined by the diameter of the splash plate 42 (i.e., deposited on the bell cup surface 92 at the portion of the bell cup surface 92 between the rotary bell cup 44 and the splash plate 42).

The rotary bell cup 44 may rotate generally about the longitudinal fluid tip axis 72. As the rotary bell cup 44 rotates, centrifugal forces cause the fluid or the air-fluid mixture contacting the inner bell cup region 100 to flow from the inner bell cup region 100 toward the middle bell cup region 102 of the bell cup surface 92. The fluid or the air-fluid mixture continues along the bell cup surface 92 of the rotary bell cup 44 until the fluid or the air-fluid mixture exits the bell cup surface 92 at the outer bell cup region 104. The fluid (e.g., coating material) or the air-fluid mixture may then be applied to and/or deposited on a target after leaving the bell cup surface 92 of the rotary bell cup 44 and the spray system 10 in general. Each of the inner bell cup region 100, the middle bell cup region 102, and the outer bell cup region 104 may span or extend about a circumference of the bell cup surface 92 of the rotary bell cup 44. As such, as the rotary bell cup 44 completes a full rotation, the fluid may contact the entire circumference of the inner bell cup region 100. As the fluid or the air-fluid mixture flows outward, the fluid or the air-fluid mixture may continue to flow over the entire circumferential surface areas of the middle bell cup region 102 and the outer bell cup region 104.

As described above, as the rotary bell cup 44 rotates, a negative pressure may be created in the rotary bell cup 44, and air may be drawn from an environment adjacent to the rotary bell cup 44 into the rotary bell cup 44 toward the splash plate 42. The splash plate 42 may be configured to block the air being drawn into the rotary bell cup 44 from disrupting the flow of a fluid or an air-fluid mixture from the fluid exit port 80 onto the rotary bell cup 44 at the inner bell cup region 100. In some embodiments, the fluid or the air-fluid mixture may exit the fluid exit port 80 at a high velocity. In traditional systems, a fluid or an air-fluid mixture directed toward a splash plate at a high velocity may cause wear on the splash plate. However, because the fluid or the air-fluid mixture is not distributed directly onto the splash plate 42 of the embodiments discussed herein, the splash plate 42 may last for longer periods of time before being replaced compared to traditional systems.

Figure 5:
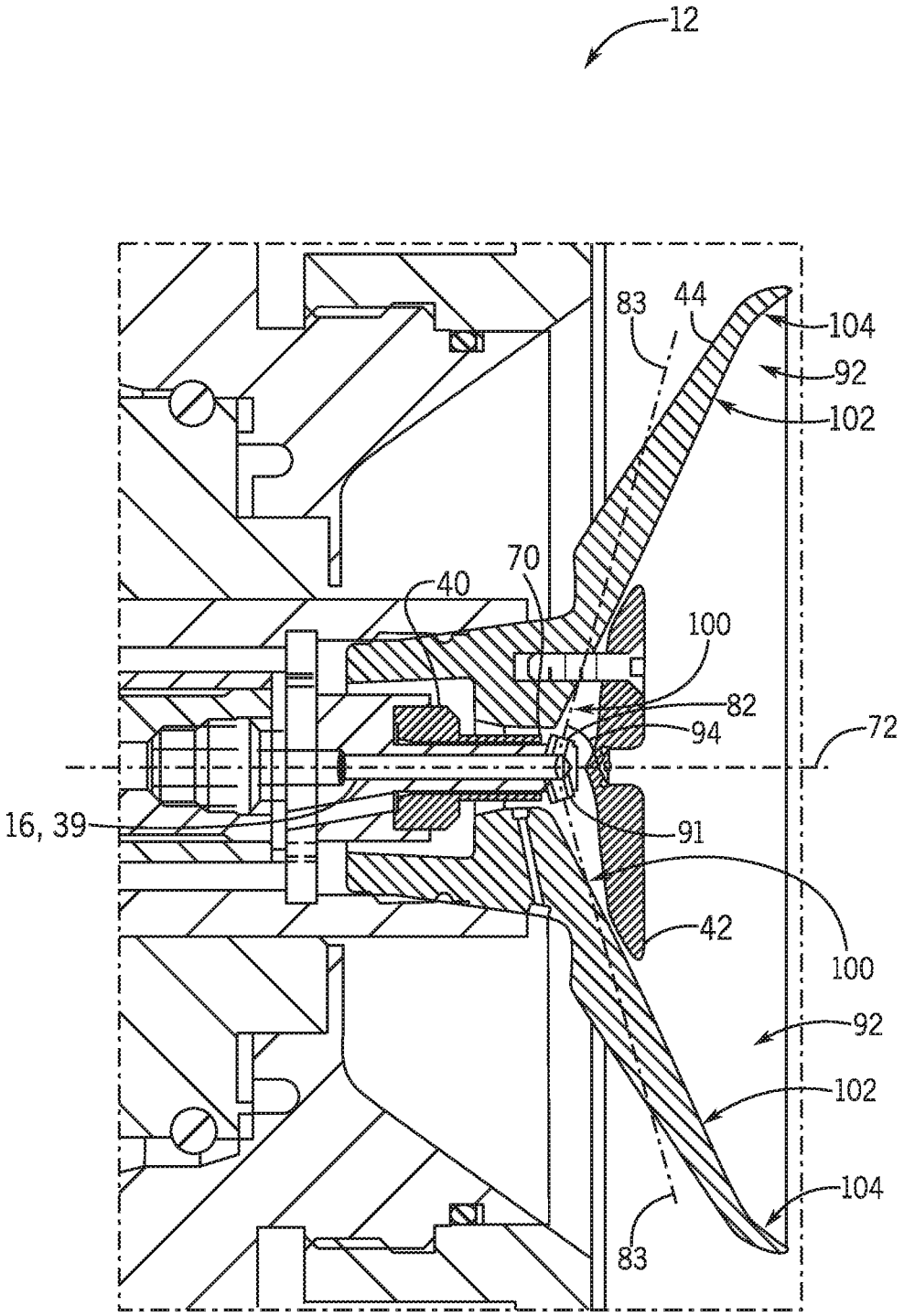
FIG. 5 is a partial cross-sectional side view of an embodiment of the fluid tip of the spray system of FIG. 1, in accordance with aspects of the present disclosure.

FIG. 5 is a partial cross-sectional side view of the spray applicator 12 of the spray system 10 of FIG. 1, illustrating an embodiment of the fluid tip 40 of the spray applicator 12. As similarly described above, the illustrated spray system 10 is configured to flow a fluid or an air-fluid mixture through the fluid tip 40 along the longitudinal fluid tip axis 72, out of two fluid exit port outlets 91 of respective fluid exit ports 82, and onto the bell cup surface 92 of the rotary bell cup 44. The fluid or the air-fluid mixture exits the fluid exit port outlets 91 along respective fluid exit axes 83. In the illustrated embodiment, the two fluid exit ports 82 (e.g., a first fluid exit port and a second fluid exit port) protrude generally radially outward from the side surface 70 or outer diameter of the fluid tip 40. The fluid exit ports 82 may extend along respective fluid exit axes 83 (e.g., along a first fluid exit axis and along a second fluid exit axis).

The flow path of the fluid or the air-fluid mixture out of each fluid exit port 82 (along each fluid exit axis 83) is at an angle 94 relative to the longitudinal fluid tip axis 72. For example, the angles 94 between each fluid exit axis 83 and the longitudinal fluid tip axis 72 facing the splash plate 42 may be generally acute (e.g., 89 degrees, 88 degrees, 87 degrees, etc.). This acute angle may enhance or improve deposition of the fluid or the air-fluid mixture on the bell cup surface 92 by enabling the fluid or the air-fluid mixture exiting the fluid exit ports 82 to more smoothly contact and flow along the bell cup surface 92 of the rotary bell cup 44 at the inner bell cup region 100. In some embodiments, the angles 94 may be approximately 90 degrees and/or may be approximately equal to one another. The angles 94 between each fluid exit axis 83 and the longitudinal fluid tip axis 72 may also be different (e.g., a first angle between a first fluid exit axis and the longitudinal fluid tip axis and a second angle between a second fluid exit axis and the longitudinal fluid tip axis).

The fluid exit ports 82 may be disposed on opposite sides of the fluid tip 40 relative to the longitudinal fluid tip axis 72 and may be configured to direct the fluid or the air-fluid mixture toward the inner bell cup region 100 as the fluid or the air-fluid mixture leaves the fluid tip 40. As the fluid or the air-fluid mixture exits the fluid exit ports 82, the fluid or the air-fluid mixture is generally directed away from the splash plate 42 and toward the rotary bell cup 44. As such, deposition of the fluid or the air-fluid mixture onto the bell cup surface 92 may be enhanced and potential wear on the splash plate 42 may be reduced. The fluid or the air-fluid mixture may contact the bell cup surface 92 simultaneously at two locations (e.g., at two locations of the inner bell cup region 100). As the rotary bell cup 44 rotates, the fluid or the air-fluid mixture may flow along the bell cup surface 92 from the inner bell cup region 100 toward the middle bell cup region 102, from the middle bell cup region 102 toward the outer bell cup region 104, and exit the bell cup surface 92 at the outer bell cup region 104.

Figure 6:
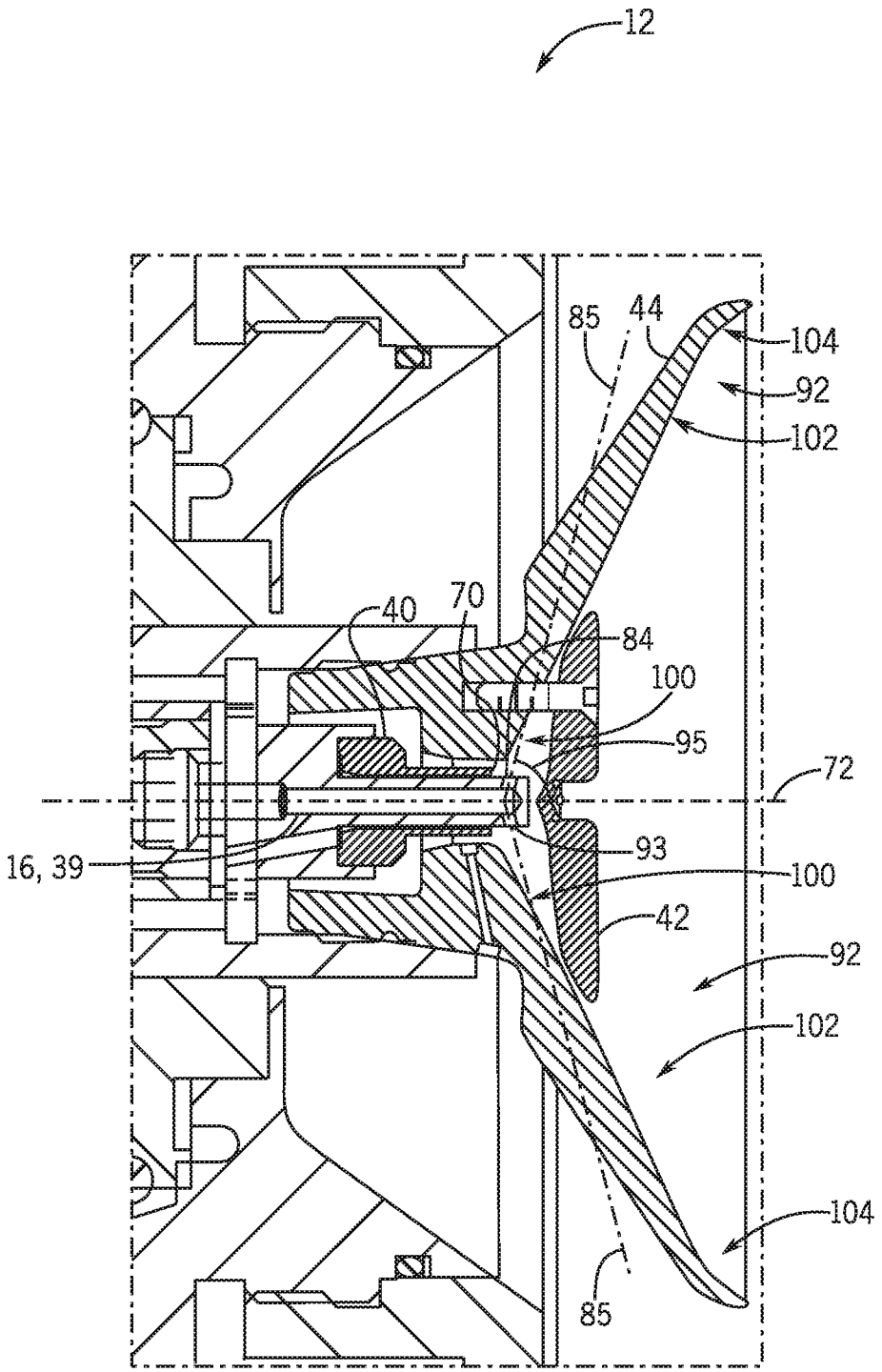
FIG. 6 is a partial cross-sectional side view of an embodiment of the fluid tip of the spray system of FIG. 1, in accordance with aspects of the present disclosure.

FIG. 6 is a partial cross-sectional side view of the spray applicator 12 of the spray system 10 of FIG. 1, illustrating an embodiment of the fluid tip 40 of the spray applicator 12. The spray system 10 is configured to flow a fluid or an air-fluid mixture through the fluid tip 40 along the longitudinal fluid tip axis 72, out of two fluid exit port outlets 93 of respective fluid exit ports 84, and onto the bell cup surface 92 of the rotary bell cup 44. The fluid or the air-fluid mixture exits the fluid exit port outlets 93 along respective fluid exit axes 85. In the illustrated embodiment, the two fluid exit ports 84 are generally flush with the side surface 70 or outer radial surface of the fluid tip 40. The flow path of the fluid out of each fluid exit port 84 (along its respective fluid exit axis 85) is at an angle 95 relative to the longitudinal fluid tip axis 72. For example, the angle 95 between each fluid exit axis 85 and the longitudinal fluid tip axis 72 facing the splash plate 42 is generally acute. As the fluid or the air-fluid mixture exits the fluid exit ports 84, the fluid or the air-fluid mixture is generally directed away from the splash plate 42 and toward the rotary bell cup 44. As a result, the fluid or the air-fluid mixture may not be deposited directly onto the splash plate 42, thereby reducing wear and degradation on the splash plate 42 caused by the direct application of the fluid or the air-fluid mixture onto the splash plate 42 at high speed. The fluid exit ports 84 may be disposed on opposite sides of the fluid tip 40 relative to one another and may be configured to direct the fluid or the air-fluid mixture toward the inner bell cup region 100 of the bell cup surface 92 as the fluid or the air-fluid mixture leaves the fluid tip 40. As such, the fluid or the air-fluid mixture may contact the rotary bell cup 44 simultaneously at two locations (e.g., at two locations of the inner bell cup region 100).

Figure 7:
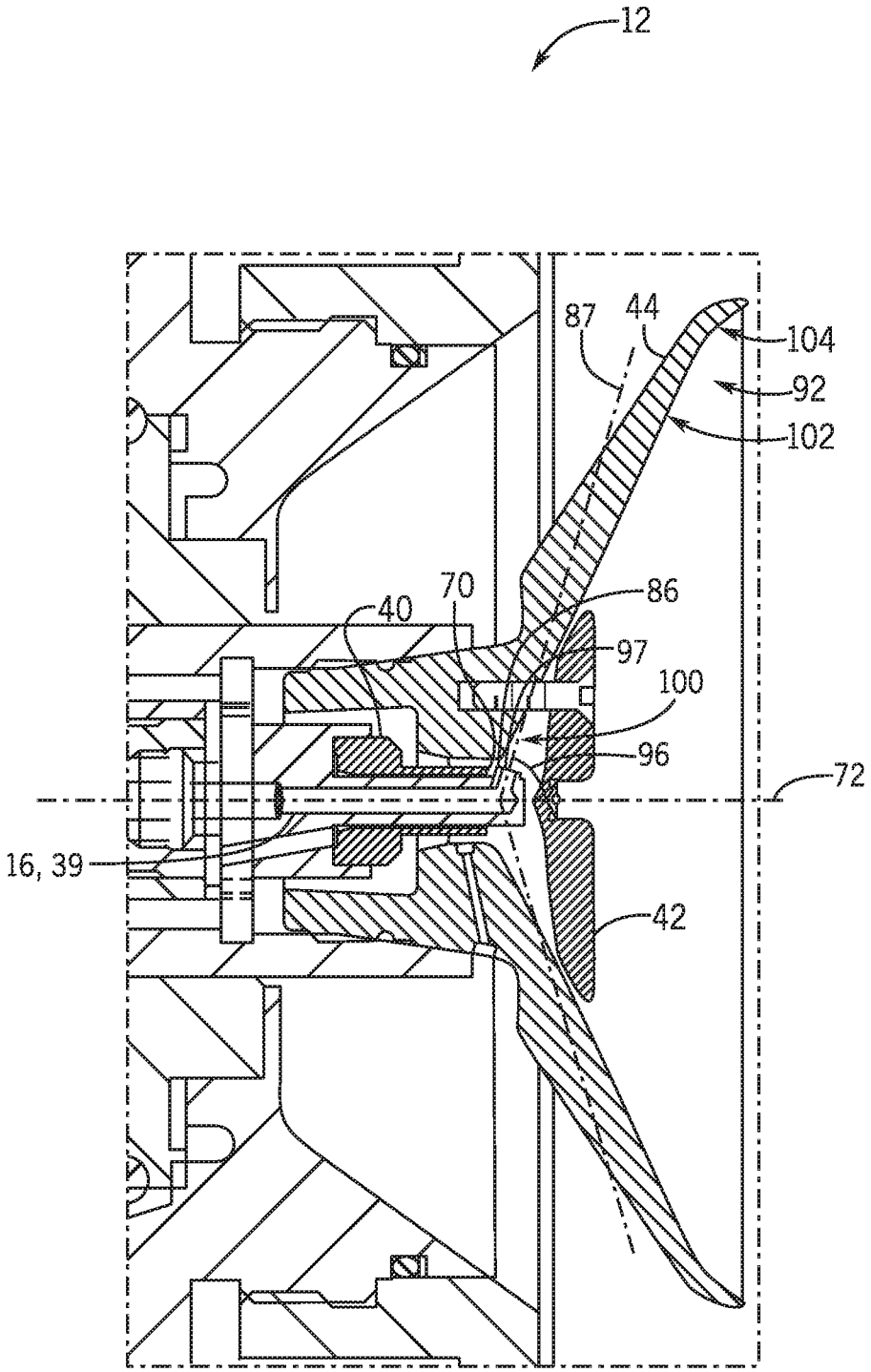
FIG. 7 is a partial cross-sectional side view of an embodiment of the fluid tip of the spray system of FIG. 1, in accordance with aspects of the present disclosure.

FIG. 7 is a partial cross-sectional side view of the spray applicator 12 of the spray system 10 of FIG. 1, illustrating an embodiment of the fluid tip 40 of the spray applicator 12. The spray system 10 is configured to flow a fluid or an air-fluid mixture through the fluid tip 40 along the longitudinal fluid tip axis 72, out of a fluid exit port outlet 97 of a fluid exit port 86, and onto the bell cup surface 92 of the rotary bell cup 44. The fluid or air-fluid mixture exits the fluid exit port outlet 97 along a fluid exit axis 87. As the fluid or the air-fluid mixture exits the fluid exit port outlet 97, the fluid or the air-fluid mixture is generally directed away from the splash plate 42 and toward the rotary bell cup 44. As a result, the fluid or the air-fluid mixture may not be deposited directly onto the splash plate 42, thereby reducing wear and degradation on the splash plate 42 caused by the direct application of the fluid onto the splash plate 42 at high speed. In the illustrated embodiment, the fluid exit port 86 protrudes outward from the side surface 70 or the outer radial surface of the fluid tip 40. The flow path of the fluid or the air-fluid mixture out of the fluid exit port outlet 97 (along the fluid exit axis 87) is at an angle 96 relative to the longitudinal fluid tip axis 72. For example, the angle 96 between the fluid exit axis 87 and the longitudinal fluid tip axis 72 facing the splash plate 42 is generally acute. As such, deposition of the fluid or the air-fluid mixture on the bell cup surface 92 of the rotary bell cup 44 may be improved by enabling the fluid or the air-fluid mixture exiting the fluid exit port 86 to more smoothly contact and flow along the bell cup surface 92 at the inner bell cup region 100.

In some embodiments, the fluid exit axis 83 of FIG. 5, the fluid exit axis 85 of FIG. 6, or the fluid exit axis 87 of FIG. 7 may be parallel to the inner bell cup region 100 and/or the middle bell cup region 102. A parallel orientation of the fluid exit axis 83, the fluid exit axis 85, or the fluid exit axis 87 relative to the inner bell cup region 100 and/or the middle bell cup region 102 may enhance deposition of a fluid or an air-fluid mixture exiting the fluid tip 40 onto the inner bell cup region 100. The parallel orientation may also enhance a flow of the fluid or the air-fluid mixture along the inner bell cup region 100 and/or the middle bell cup region 102.

Figure 8:
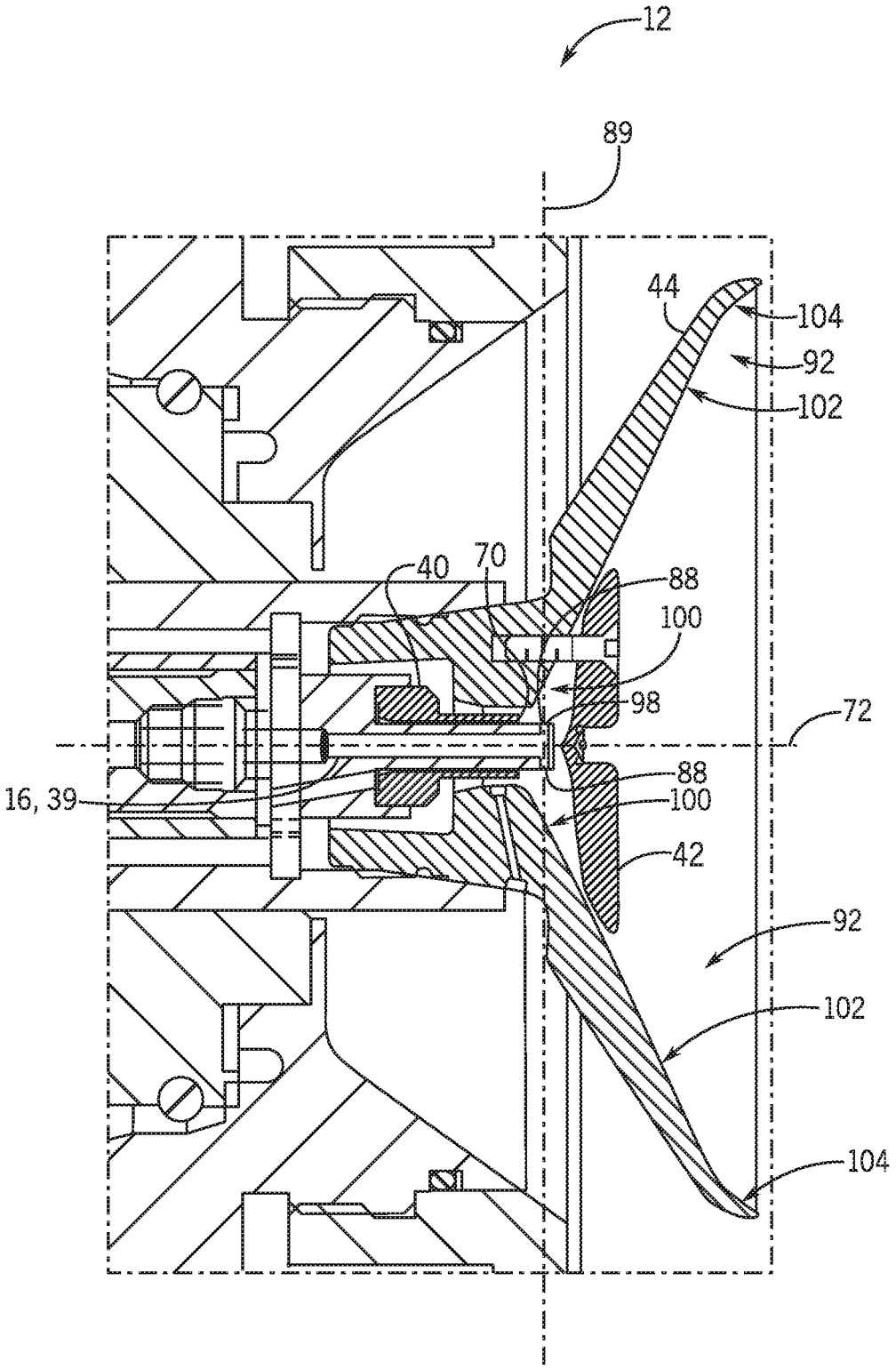
FIG. 8 is a partial cross-sectional side view of an embodiment of the fluid tip of the spray system of FIG. 1, in accordance with aspects of the present disclosure.

FIG. 8 is a partial cross-sectional side view of the spray applicator 12 of the spray system 10 of FIG. 1, illustrating an embodiment of the fluid tip 40 of the spray applicator 12. As similarly describe above, the spray system 10 is configured to flow a fluid or an air-fluid mixture through the fluid tip 40 along the longitudinal fluid tip axis 72, out of two fluid exit port outlets 98 of respective fluid exit ports 88, and onto the bell cup surface 92 of the rotary bell cup 44. The fluid or the air-fluid mixture exits the fluid exit port outlets 98 along a fluid exit axis 89. As the fluid or the air-fluid mixture exits the fluid exit port outlets 98, the fluid or the air-fluid mixture is generally directed away from the splash plate 42 and toward the rotary bell cup 44. As a result, the fluid or the air-fluid mixture may not be deposited directly onto the splash plate 42, thereby reducing wear and degradation on the splash plate 42 caused by the direct application of the fluid or the air-fluid mixture onto the splash plate 42 at high speed. In the illustrated embodiment, the two fluid exit ports 88 are generally flush with the side surface 70 of the fluid tip 40. The flow path of the fluid or the air-fluid mixture out of each fluid exit port 88 (along each fluid exit axis 89) is generally perpendicular to the longitudinal fluid tip axis 72. For example, the angle between the fluid exit axis 89 and the longitudinal fluid tip axis 72 may be approximately 90 degrees. The fluid exit ports 88 may be disposed on opposite sides of the fluid tip 40 relative to one another and may be configured to direct the fluid or the air-fluid mixture toward the inner bell cup region 100 of the bell cup surface 92 as the fluid leaves the fluid tip 40. As such, the fluid or the air-fluid mixture may contact the rotary bell cup 44 simultaneously at two locations (e.g., at two locations of the inner bell cup region 100).

Certain embodiments of the spray system 12 may include a fluid tip with fluid exit ports disposed at angle(s) relative a longitudinal fluid tip axis of the fluid tip and/or relative to a splash plate. For example, a fluid tip may include one, two, three, four, or more fluid exit ports disposed equally or non-equally around a circumference of the fluid tip. The angle(s) between the fluid exit ports and the longitudinal fluid tip axis may vary among certain embodiments. For example, a fluid exit port may be at an angle that directs a fluid or an air-fluid mixture backward away from the splash plate and toward a rotary bell cup. As the fluid exit ports direct the fluid or air-fluid mixture toward the rotary bell cup and away from the splash plate, deposition of the fluid or the air-fluid mixture onto the rotary bell cup may be enhanced and potential wear on the splash plate may be reduced and/or eliminated. The angle of the fluid exit port relative to the rotary bell cup and/or the splash plate may vary in certain embodiments. Additionally, the splash plate may block air from entering a region between the splash plate and the rotary bell cup to enable the fluid or the air-fluid mixture exiting the fluid tip to more smoothly contact and flow along the rotary bell cup. Further, some embodiments of a fluid tip may include additional or other fluid ports configured to flow a fluid or an air-fluid mixture to various portions of the spray system 12.

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims.

The invention claimed is:

1. A spray system, comprising:

a spray applicator configured to apply a fluid to a target;

a rotary bell cup of the spray applicator, wherein the rotary bell cup comprises an inner bell cup region;

a splash plate of the spray applicator coupled to the rotary bell cup; and a fluid tip of the spray applicator, wherein the fluid tip is configured to output the fluid onto the rotary bell cup, wherein the fluid tip comprises:

a fluid tip passage extending along a longitudinal fluid tip axis of the fluid tip, wherein the longitudinal fluid tip axis intersects with the splash plate;

a first fluid exit port configured to output the fluid from the fluid tip passage onto the rotary bell cup, wherein the first fluid exit port extends along a first fluid exit axis disposed at a first acute angle relative to the longitudinal fluid tip axis of the fluid tip; and a second fluid exit port configured to output the fluid from the fluid tip passage into the inner bell cup region, wherein the second fluid exit port comprises a second fluid exit axis disposed at a second angle relative to the longitudinal fluid tip axis of the fluid tip.

2. The spray system of claim 1, wherein the spray applicator comprises a fluid tube configured to flow the fluid through the spray applicator, and wherein the fluid tube is fluidly coupled to the fluid tip passage of the fluid tip.

3. The spray system of claim 1, wherein the first fluid exit axis of the first fluid exit port intersects the inner bell cup region of the rotary bell cup.

4. The spray system of claim 3, wherein a point of intersection between the first fluid exit axis of the first fluid exit port and the inner bell cup region of the rotary bell cup is within a region defined at least partially by a diameter of the splash plate.

5. The spray system of claim 1, wherein the first fluid exit port and the second fluid exit port are disposed on opposite sides of the fluid tip relative to the longitudinal fluid tip axis of the fluid tip.

6. The spray system of claim 1, wherein the first acute angle and the second angle are approximately equal to one another.

7. The spray system of claim 1, wherein the second angle is acute.

8. A spray system, comprising:

a fluid tip of a spray applicator, wherein the fluid tip is configured to output a fluid onto a rotary bell cup of the spray applicator, wherein the fluid tip comprises:

a fluid tip passage extending along a longitudinal fluid tip axis of the fluid tip;

a first fluid exit port configured to output the fluid onto the rotary bell cup, wherein the first fluid exit port comprises a first fluid exit axis disposed at an acute angle relative to the longitudinal fluid tip axis of the fluid tip; and a second fluid exit port configured to output the fluid from the fluid tip passage into an inner bell cup region of the rotary bell cup, wherein the second fluid exit port comprises a second fluid exit axis disposed at a second angle relative to the longitudinal fluid tip axis of the fluid tip.

9. The spray system of claim 8, wherein the fluid tip comprises a solvent passage configured to flow a solvent to components of the spray applicator, wherein the solvent is configured to remove fluid residue from the components.

10. The spray system of claim 8, wherein the first fluid exit axis intersects with a bell cup surface of the rotary bell cup.

11. The spray system of claim 10, wherein the first fluid exit axis intersects with the bell cup surface of the rotary bell cup within an outer diameter of a splash plate of the spray applicator.

12. A method of operating a spray system, comprising:

flowing a fluid along a fluid tip passage of a fluid tip of a spray applicator, wherein the fluid tip passage extends along a longitudinal fluid tip axis of the fluid tip;

directing the fluid through a first fluid exit port along a first fluid exit axis, wherein the first fluid exit port is fluidly coupled to the fluid tip passage, and wherein the first fluid exit axis is disposed at a first acute angle relative to the longitudinal fluid tip axis;

directing the fluid through a second fluid exit port along a second fluid exit axis, wherein the second fluid exit port is fluidly coupled to the fluid tip passage, and wherein the second fluid exit axis is disposed at a second angle relative to the longitudinal fluid tip axis; and depositing the fluid from the first fluid exit port and the second fluid exit port onto a bell cup surface of a rotary bell cup.

13. The method of claim 12, comprising:

flowing the fluid along the bell cup surface;

directing the fluid off of the bell cup surface; and depositing the fluid onto a target.

14. The method of claim 12, wherein depositing the fluid from the first fluid exit port and the second fluid exit port onto the bell cup surface comprises directing the fluid away from a splash plate of the spray system and toward the rotary bell cup.

* * * * *